US009099822B2

(12) United States Patent
Miki et al.

(10) Patent No.: US 9,099,822 B2
(45) Date of Patent: Aug. 4, 2015

(54) CONNECTOR HAVING A HOUSING AND A FIXED CONTACT WITH FIRST AND SECOND FIXING PORTIONS SECURED TO THE HOUSING

(71) Applicants: FUJITSU COMPONENT LIMITED, Tokyo (JP); FUJITSU LIMITED, Kawasaki-shi, Kanagawa (JP)

(72) Inventors: Yasuyuki Miki, Tokyo (JP); Mitsuru Kobayashi, Tokyo (JP); Takatoshi Yagisawa, Kawasaki (JP)

(73) Assignees: FUJITSU COMPONENT LIMITED, Tokyo (JP); FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/186,041

(22) Filed: Feb. 21, 2014

(65) Prior Publication Data

US 2014/0242846 A1 Aug. 28, 2014

(30) Foreign Application Priority Data

Feb. 22, 2013 (JP) ..... 2013-033612

(51) Int. Cl.

| | |
|---|---|
| ***H01R 13/62*** | (2006.01) |
| ***H01R 12/79*** | (2011.01) |
| ***H01R 12/50*** | (2011.01) |
| ***H01R 12/88*** | (2011.01) |
| *H01R 12/72* | (2011.01) |

(52) U.S. Cl.

CPC ..... *H01R 12/79* (2013.01); *H01R 12/88* (2013.01); *H01R 23/6813* (2013.01); *H01R 12/721* (2013.01)

(58) Field of Classification Search

USPC ..... 439/630, 259–264

See application file for complete search history.

(56) References Cited

U.S. PATENT DOCUMENTS

| | | | | |
|---|---|---|---|---|
| 7,540,764 | B2 * | 6/2009 | Suzuki et al. | 439/495 |
| 7,766,680 | B2 * | 8/2010 | Suzuki et al. | 439/260 |
| 7,766,694 | B2 * | 8/2010 | Tanaka et al. | 439/495 |
| 7,828,570 | B2 * | 11/2010 | Suzuki et al. | 439/260 |
| 8,128,425 | B2 * | 3/2012 | Takahashi et al. | 439/260 |
| 2009/0068860 | A1 | 3/2009 | Suzuki et al. | |
| 2010/0087078 | A1 | 4/2010 | Hemmi et al. | |

FOREIGN PATENT DOCUMENTS

| | | |
|---|---|---|
| JP | 4945006 | 6/2012 |
| KR | 10-1030655 | 4/2011 |

* cited by examiner

*Primary Examiner* — Chandrika Prasad

(74) *Attorney, Agent, or Firm* — IPUSA, PLLC

(57) ABSTRACT

A connector to be mounted on a board and connect a connection object to the board includes a housing into which the connection object is inserted through an insertion slot and multiple contacts each of which comes into contact with the connection object and the board. Each of the contacts includes a movable contact that comes into contact with a first surface of the connection object, a fixed contact that comes into contact with the board and includes fixing portions for fixing the fixed contact to the housing, and a connecting part that connects the movable contact and the fixed contact. Each of the fixing portions branches and projects from a signal transmission line provided between the connection object and the board. The movable contact is rotatable relative to the fixed contact.

6 Claims, 7 Drawing Sheets

CONNECTOR HAVING A HOUSING AND A FIXED CONTACT WITH FIRST AND SECOND FIXING PORTIONS SECURED TO THE HOUSING

CROSS-REFERENCE TO RELATED APPLICATION

The present application is based upon and claims the benefit of priority of Japanese Patent Application No. 2013-033612, filed on Feb. 22, 2013, the entire contents of which are incorporated herein by reference.

BACKGROUND OF THE INVENTION

1. Field of the Invention

The present invention relates to connectors.

2. Description of the Related Art

For example, connectors that connect an object to be connected (hereinafter, "connection object") such as a flexible printed circuit (FPC) to a board include a housing into which the connection object is inserted and multiple contacts that are fixed to the housing and connect the connection object to the board. (See, for example, Japanese Patent No. 4945006.)

Each of these contacts includes first and second contact parts that come into contact with the connection object and the board, respectively. In addition, each of the contacts includes, for example, a projecting part that branches and projects from between the two contact parts, and is fixed to the housing with the projecting part fitted to a corresponding fitting hole provided in the housing. In order for each of the contacts to be fixed to the housing with a single projecting part thus formed, the projecting part is required to have a certain length.

SUMMARY OF THE INVENTION

According to an aspect of the present invention, a connector to be mounted on a board and connect a connection object to the board includes a housing into which the connection object is inserted through an insertion slot and multiple contacts each of which comes into contact with the connection object and the board. Each of the contacts includes a movable contact that comes into contact with a first surface of the connection object, a fixed contact that comes into contact with the board and includes fixing portions for fixing the fixed contact to the housing, and a connecting part that connects the movable contact and the fixed contact. Each of the fixing portions branches and projects from a signal transmission line provided between the connection object and the board. The movable contact is rotatable relative to the fixed contact.

DESCRIPTION OF THE EMBODIMENTS

Figure 1:
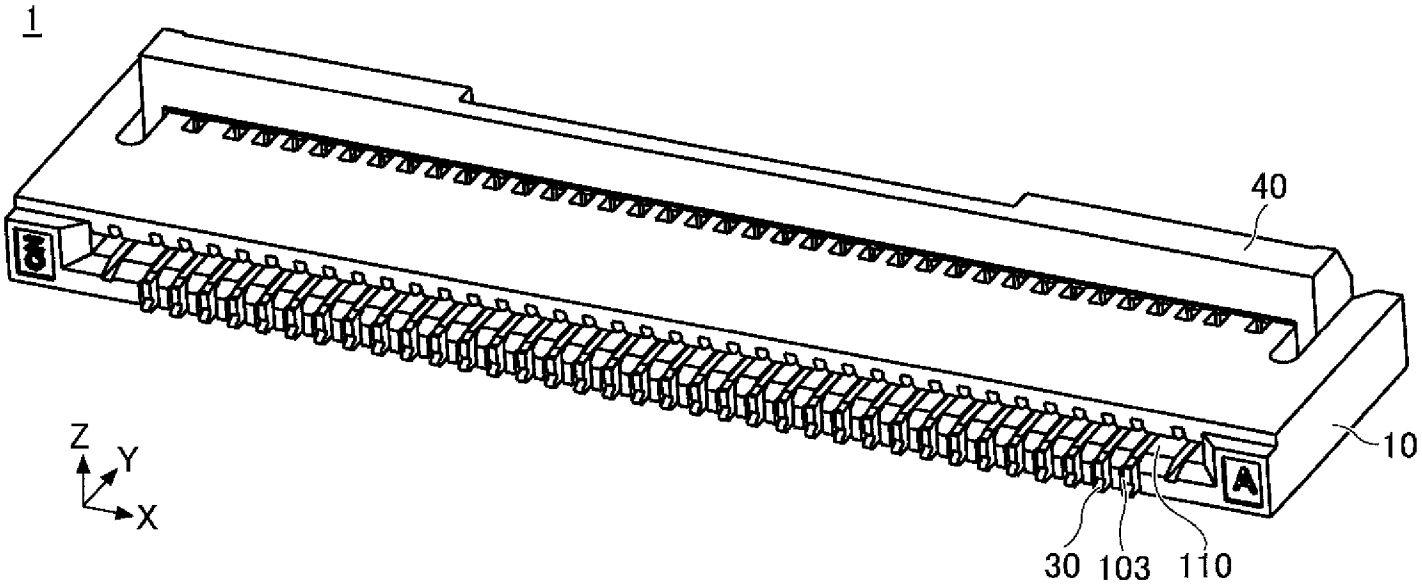
FIG. 1 is a perspective view of a connector according to an embodiment.

One or more embodiments of the present invention are described below with reference to the accompanying drawings. In each of the drawings, the same elements are referred to by the same reference numerals, and their description may not be repeated.

Figure 2:
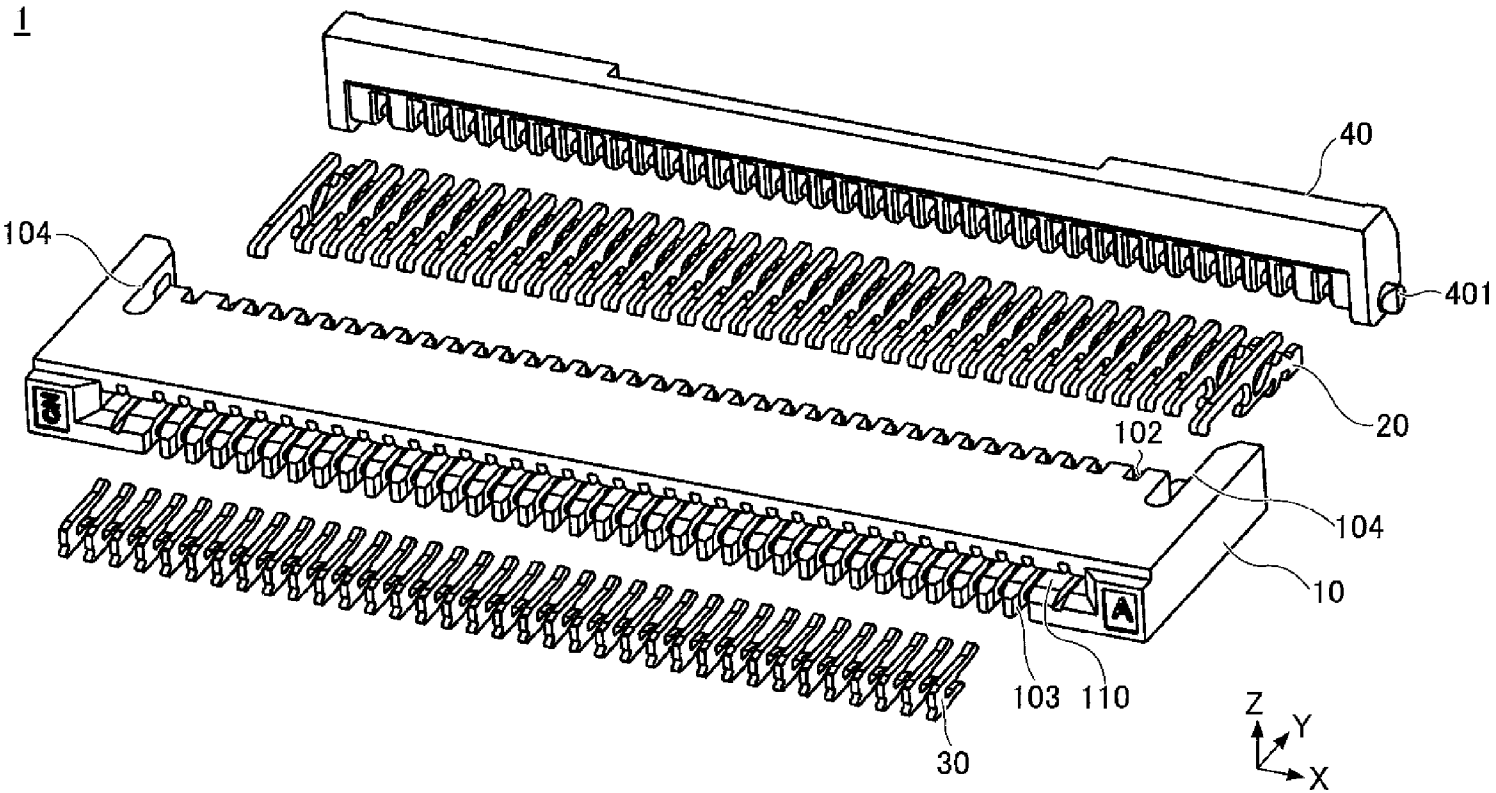
FIG. 2 is an exploded perspective view of the connector according to the embodiment.
Figure 3A:
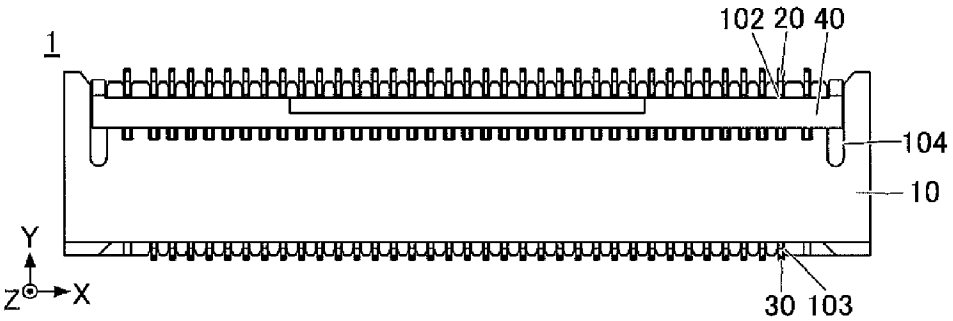
FIGS. 3A, 3B, 3C and 3D are a plan view, a front view, a bottom view and a side view, respectively, of the connector according to the embodiment.
Figure 3B:
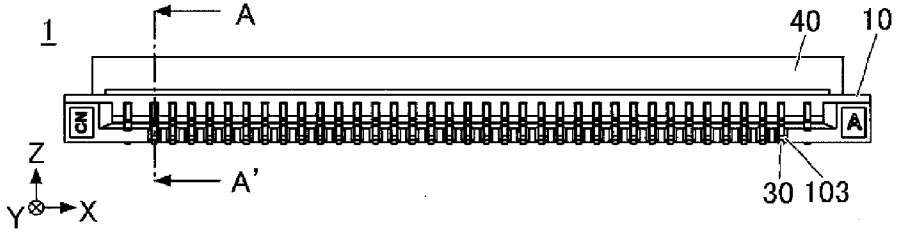
Figure 3C:
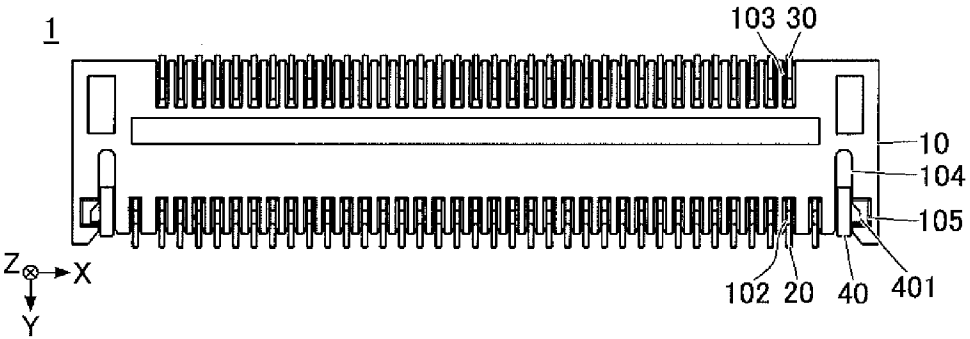
Figure 3D:
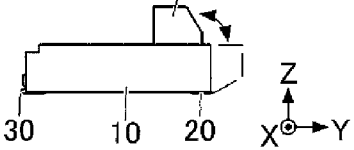
Figure 4:
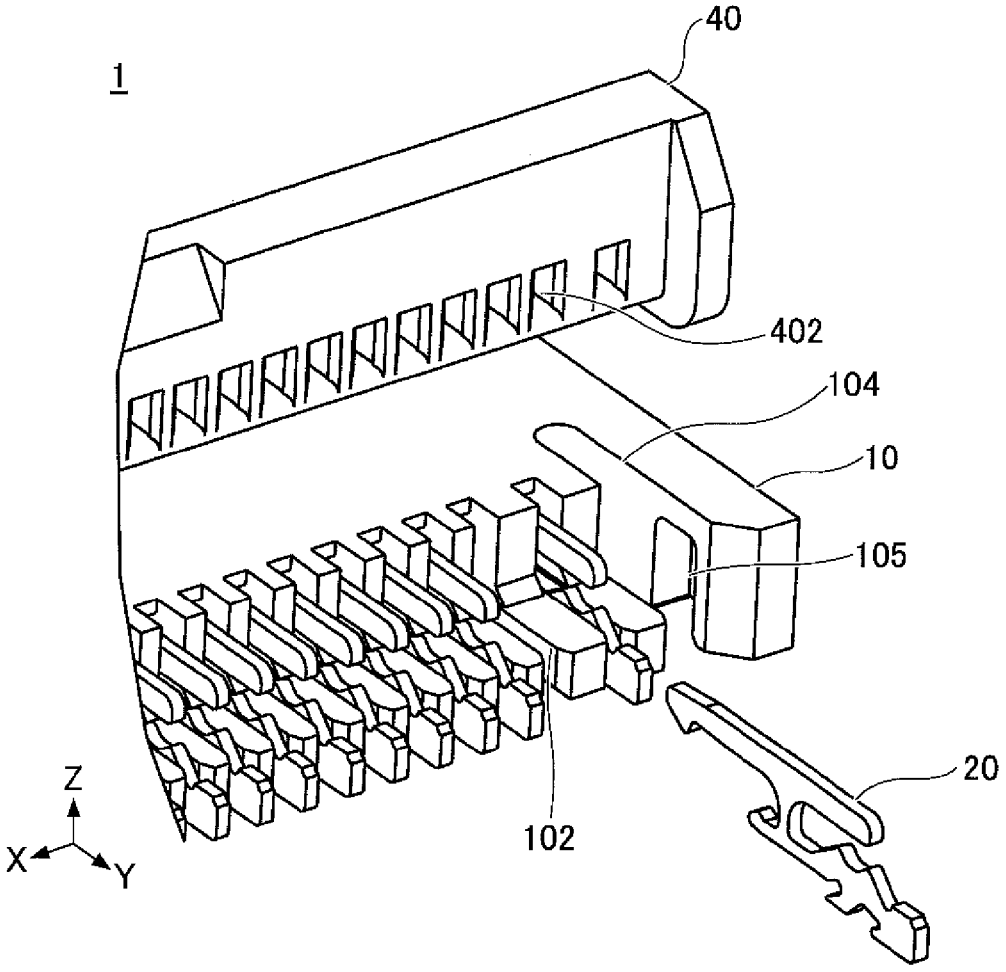
FIG. 4 is an enlarged view of part of the connector according to the embodiment.

An overall configuration of a connector 1 according to an embodiment is described based on FIG. 1, FIG. 2, FIGS. 3A, 3B, 3C and 3D and FIG. 4. FIG. 1 is a perspective view of the connector 1. FIG. 2 is an exploded perspective view of the connector 1. FIGS. 3A, 3B, 3C and 3D are a plan view, a front view, a bottom view and a side view, respectively, of the connector 1. FIG. 4 is an enlarged view of part of the connector 1, illustrating a manner in which first contacts 20 are fixed to a housing 10. In the drawings, an X direction, a Y direction and a Z direction indicate a lengthwise direction, a widthwise direction and a height direction of the connector 1, respectively.

Referring to FIG. 2, the connector 1 includes the housing 10, the first contacts 20, second contacts 30, and an actuator 40. A lower surface side of the housing 10 in FIG. 1 is fixed to a board by soldering.

Referring to FIG. 2, the housing 10 includes an insertion slot 110 for inserting a connection object, multiple first contact holes 102 to which the first contacts 20 are fixed, and multiple second contact holes 103 to which the second contacts 30 are fixed.

The connector 1 connects the board and a connection object having a flat plate shape, such as a flexible printed circuit (FPC) or a flexible flat cable (FFC), inserted through the insertion slot 110. In the following description, the board side of the connector 1 in the Z direction may be considered as "lower side" or "downside" and the side of the connector 1 opposite to the board side may be considered as "upper side" or "upside".

The first contact holes 102 are provided at regular intervals in a row in the X direction on the side of the housing 10 opposite to the insertion slot 110 in the Y direction. The first contacts 20 are inserted into and fixed to the corresponding first contact holes 102.

The second contact holes 103 are provided at regular intervals in a row in the X direction on the insertion slot 110 side of the housing 10 in the Y direction. The second contacts 30 are inserted into and fixed to the corresponding second contact holes 103.

Furthermore, the housing 10 includes support grooves 104 that support the actuator 40 serving as a pressing part. The actuator 40 inserted into the support grooves 104 is rotatably supported by the housing 10. As illustrated in FIG. 3C, a fitting groove 105 is provided in each of the support grooves 104 of the housing 10. A projecting part 401 is provided on each of side surfaces of the actuator 40 (only one of the projecting parts 401 on the right side surface of the actuator 40 is illustrated in FIG. 2). The fitting grooves 105 fit with the corresponding projecting parts 401. The actuator 40 is supported by the housing 10 by having the projecting parts 401 fitting in the fitting grooves 105 of the support grooves 104 of the housing 10. Furthermore, the actuator 40 is supported by the housing 10 so as to be rotatable about the projecting parts 401 in directions indicated by a double-headed arrow in FIG. 3D. The actuator 40 presses the first contacts 20 against a connection object inserted into the housing 10 by being rotated in such a manner as to tilt downward.

The first contacts 20 and the second contacts 30 are blanked out from a conductive metal material having a thin plate shape, for example. The first contacts 20 and the second contacts 30 connect a board and a connection object inserted through the insertion slot 110 of the housing 10. Furthermore, the first contacts 20 and the second contacts 30 are arranged so that a signal line (S) and a ground line (G) are adjacent to each other (for example, in a manner such as GSGSG . . . or GSSG . . . ), and there is a match in impedance at a desired impedance level between adjacent contacts.

The first contacts 20 are fixed to the corresponding first contact holes 102 of the housing 10 to connect one surface of the connection object and the board. Each of the first contacts 20 includes a part exposed from the housing 10 to come into contact with a terminal on the board and a part that comes into contact with a terminal on the upper surface of the connection object inserted into the housing 10.

FIG. 4 is an enlarged view of part of the connector 1, illustrating a manner in which the first contacts 20 are fixed to the first contact holes 102 of the housing 10. As illustrated in FIG. 4, the first contact 20 is inserted into and fixed to the first contact hole 102 of the housing 10. The housing 10, having the first contacts 20 fixed to the first contact holes 102, further supports the actuator 40 inserted into the support grooves 104. The actuator 40 is rotatably supported by the housing 10 by having the projecting parts 401 on the side surfaces fitting into the fitting grooves 105 provided in the support grooves 104 of the housing 10. Furthermore, the actuator 40 is supported by the housing 10 with part of each the first contacts 20 being inserted into a corresponding one of insertion holes 402 provided at regular intervals in the X direction.

Referring to FIG. 1 and FIGS. 3A through 3D, each second contact 30 is fixed to the second contact hole 103 of the housing 10 to connect another surface of the connection object and the board. Each of the second contacts 30 includes a part exposed from the housing 10 to come into contact with a terminal on the board and a part that comes into contact with a terminal on the lower surface of the connection object inserted into the housing 10. Like the first contacts 20, the second contacts 30 are inserted into and fixed to the second contact holes 103 provided in the housing 10.

The connector 1 according to this embodiment has the above-described configuration, and is mounted on a board to connect a connection object such as an FPC or FFC and the board.

Next, configurations of the first contacts 20, the second contacts 30, and the actuator 40 are described. In the following description, the first contacts 20 may be collectively referred to as "first contact 20" and the second contacts 30 may be collectively referred to as "second contact 30" for convenience of description.

Figure 5:
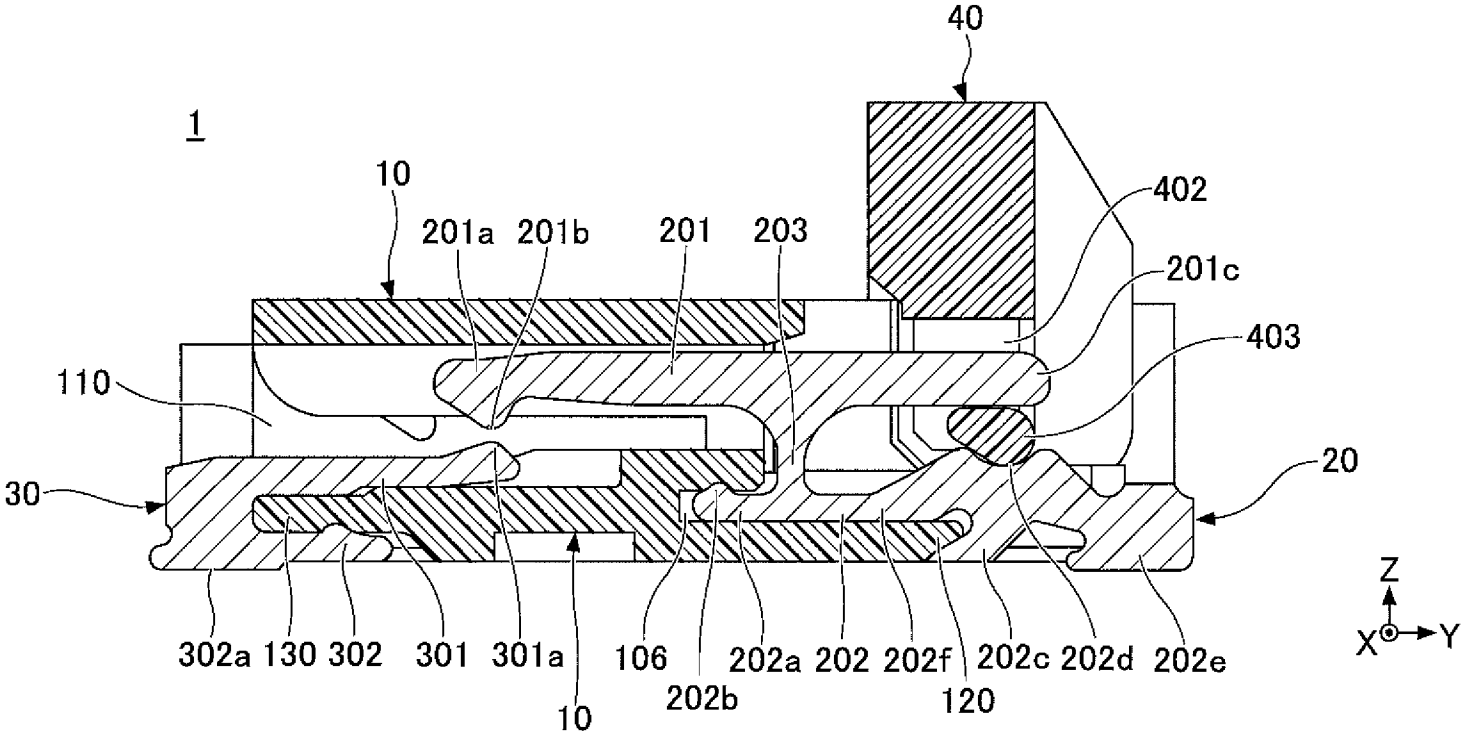
FIG. 5 is a cross-sectional view of the connector, illustrating a state before a connection object is connected to the connector according to the embodiment.
Figure 6:
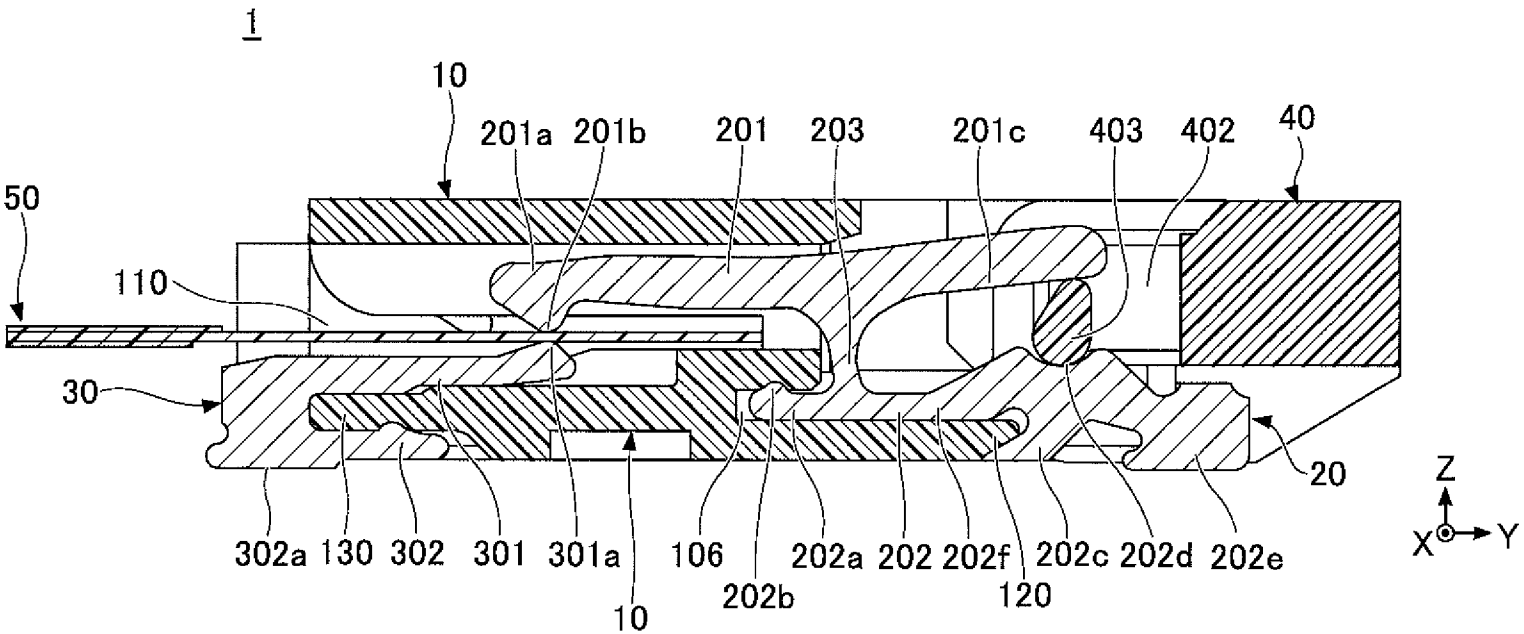
FIG. 6 is a cross-sectional view of the connector, illustrating a state after the connection object is connected to the connector according to the embodiment.

FIG. 5 and FIG. 6 are cross-sectional views taken along a Y-Z plane including a line A-A' of FIG. 3B. FIG. 5 illustrates a state where no connection object is inserted in the connector 1. FIG. 6 illustrates a state where an FPC 50 is inserted in the connector 1 as a connection object.

As illustrated in FIG. 5 and FIG. 6, the first contact 20 includes a movable contact part 201, a fixed contact part 202, and a connecting part 203.

The movable contact part 201, which is elongated substantially parallel to the Y direction, includes a front end portion 201*a* on the insertion slot 110 side of the housing 10. The front end portion 201*a* includes a contact projecting portion 201*b* that comes into contact with an upper surface of the connection object. The movable contact part 201 is connected to the fixed contact part 202 by the connecting part 203, which is elongated in the Z direction. Furthermore, the movable contact part 201 includes a rear end portion 201*c* on the side opposite to the insertion slot 110. The rear end portion 201*c* is inserted into the corresponding insertion hole 402 of the actuator 40, and a cam part 403 of the actuator 40 is held between the rear end portion 201*c* and the fixed contact part 202.

When the actuator 40 is rotated from the state of FIG. 5 to the state of FIG. 6, the rear end portion 201*c* of the movable contact part 201 is pressed upward by the cam part 403 having a substantially elliptical Y-Z cross section, and the movable contact part 201 is rotated about the connecting part 203 that elastically deforms. Furthermore, the contact projecting portion 201*b* of the front end portion 201*a* is pressed against the upper surface of the FPC 50 when the actuator 40 is rotated.

The connecting part 203 connects the movable contact part 201 and the fixed contact part 202. Furthermore, the connecting part 203, while elastically deforming, supports the movable contact part 201 that rotates in accordance with a movement of the actuator 40.

The fixed contact part 202 includes a first fixing portion 202*a*, a second fixing portion 202*c*, a cam groove 202*d*, a board contact portion 202*e*, and a body portion 202*f*. The fixed contact part 202 is fixed to the housing 10 to come into contact with the board.

The first fixing portion 202*a* projects from the portion of the fixed contact part 202 connected to the connecting part 203 toward the insertion slot 110 of the housing 10, and fixes the fixed contact part 202 to the housing 10 by fitting into one of fitting holes 106 provided in the housing 10. The first fixing portion 202*a* includes an upward projecting claw portion 202*b* in an end part of the first fixing portion 202*a*. The thickness of part of the first fixing portion 202*a* where the claw portion 202*a* is provided in the Z direction is greater than the height of the fitting holes 106 of the housing 10 in the Z direction. Accordingly, the first fixing portion 202*a* is inserted into the corresponding fitting hole 106 of the housing 10 in a press-fitted manner to have the claw portion 202*b* catching the fitting hole 106. As a result, the first fixing portion 202*a* is fixed to the housing 10 and prevented from coming out of the fitting hole 106.

In this embodiment, the first fixing portion 202*a* is provided so as to project substantially parallel to the Y direction. The first fixing portion 202*a*, however, may alternatively be provided to project upward or downward. Furthermore, it is preferable to reduce the length of part of the first fixing portion 202*a* projecting from the connecting part 203 on condition that the first contact 20 is fixed to the housing 10 and prevented from dropping off of the housing 10. It is possible to prevent transmission characteristics of the connector 1 from being affected by the first fixing portion 202*a* and degraded in the case of performing high-speed transmission between the board and the FPC 50 via the first contact 20.

The second fixing portion 202*c* projects downward toward the board from the body portion 202*f*, which is elongated substantially parallel to the Y direction along the housing 10, and is latched by and fixed to a first contact side end part 120 of the housing 10 on the side opposite to the insertion slot 110. Furthermore, the second fixing portion 202*c* is fixed to the housing 10 by holding the first contact side end part 120 between the second fixing portion 202*c* and the body portion 202*f*.

The cam groove 202*d* is provided in an upper part of the fixed contact part 202, so that the cam part 403 of the actuator 40 is held between the cam groove 202*d* and the rear end portion 201*c*. The cam groove 202*d* is formed into an arc shape curved along the cam part 403 of the actuator 40.

The board contact portion 202*e* is provided on the side of the housing 10 opposite to the insertion slot 110. A lower surface of the board contact portion 202*e* is exposed from the housing 10 to come into contact with a terminal provided on the board.

The first contact 20 has the shape as illustrated above, and is fixed to the housing 10 through multiple fixing portions, that is, the first fixing portion 202*a* and the second fixing portion 202*c*.

A fixing portion provided to fix a contact to a housing behaves as an open stub that branches and projects from a signal transmission path from a board to a connection object, and may significantly degrades transmission characteristics at particular frequencies. For example, in order to fix a contact to a housing through a single fixing portion, the fixing portion is required to have a sufficient length, which may result in degraded transmission characteristics.

The first contact 20 according to this embodiment, however, includes multiple fixing portions and is capable of keeping a fixing force of fixation to the housing 10 although their respective lengths of projection are reduced as fixing portions, compared with the case of being fixed to the housing 10 through a single fixing portion. Furthermore, because of a reduced length of a fixing portion projecting from a signal transmission path, the first contact 20 is capable of reducing the influence of a fixing portion over transmission characteristics.

Figure 7:
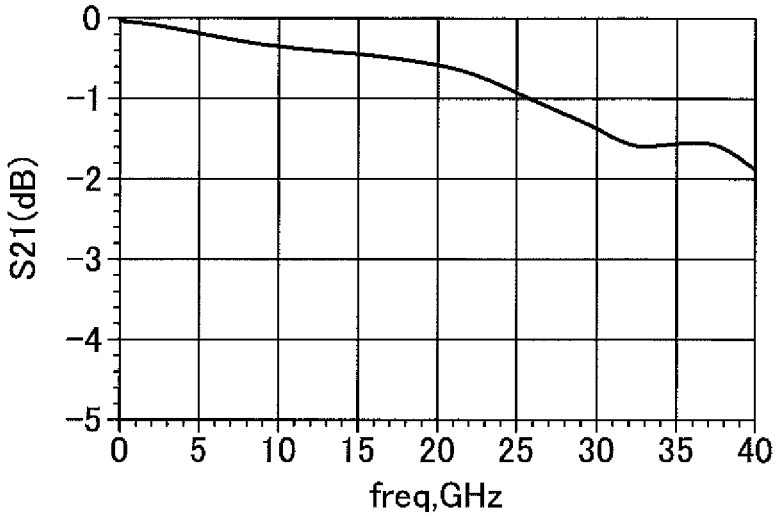
FIG. 7 is a graph illustrating the result of a simulation of a transmission characteristic of the connector according to the embodiment.

FIG. 7 is a graph illustrating the result of a simulation of a transmission characteristic of the connector 1 according to this embodiment. As illustrated in FIG. 7, according to the connector 1 of this embodiment, a good transmission characteristic is obtained over a wide frequency band, and it is possible to support high-speed transmission.

Figure 8:
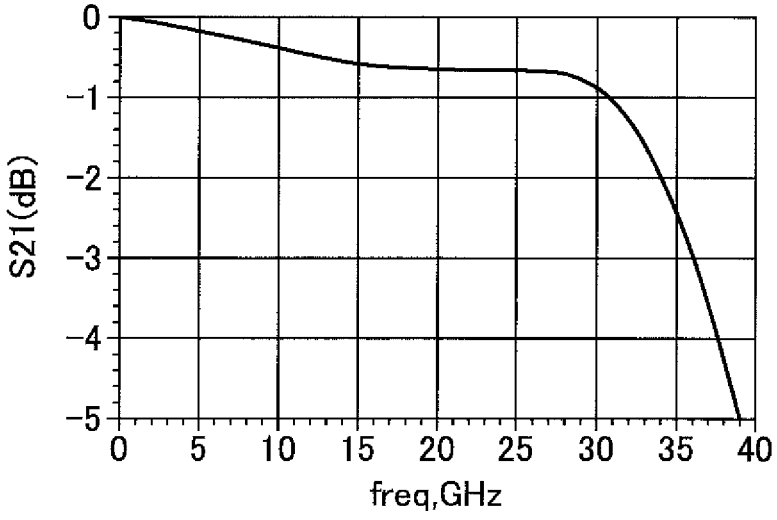
FIG. 8 is a graph illustrating the result of a simulation of a transmission characteristic of a connector.

FIG. 8 is a graph illustrating the result of a simulation of a transmission characteristic of a connector where each of contacts that connect a board and a connection object is fixed to a housing through a single projecting fixing portion. As illustrated in FIG. 8, a transmission characteristic is degraded at frequencies higher than or equal to 30 GHz because of the influence of the fixing portions of the contacts. Accordingly, a connector where each of contacts is fixed to a housing through a single fixing portion may not be able to support high-speed transmission.

Fixing portions of the first contact 20 are not limited to the two fixing portions, namely, the first fixing portion 202*a* and the second fixing portion 202*c*, and the first contact 20 may have any plural number of fixing portions. Furthermore, the first contact 20 may have fixing portions provided at positions different from those of the first fixing portion 202*a* and the second fixing portion 202*c*.

Referring to FIG. 5 and FIG. 6, the second contact 30 includes a connection object contact part 301 and a board contact part 302.

The second contact 30 is fixed to the housing 10 by holding a second contact side end portion 130 of the housing 10 on its insertion slot 110 side between the connection object contact part 301 and the board contact part 302.

A portion of the connection object contact part 301, which portion faces the front end portion 201*a* of the movable contact part 201 of the first contact 20 on the insertion slot 110 side, curves upward. A contact projecting portion 301*a* that further projects upward from an end part of this upward curving portion comes into contact with a terminal on the lower surface of the connection object.

A lower surface 302*a* of the board contact part 302 is exposed from the housing 10 to come into contact with a terminal on the board.

The second contact 30 is fixed to the second contact side end part 130 of the housing 10 to connect the board and a terminal on the lower surface of the connection object inserted through the insertion slot 110.

As illustrated in FIG. 5 and FIG. 6, the actuator 40 has the rear end portion 201*c* of the movable contact part 201 of the first contact 20 inserted into the insertion hole 402 and has the cam part 403 held between the rear end portion 201*c* of the movable contact part 201 and the cam groove 202*d* of the fixed contact part 202 of the first contact 20.

The cam part 403 has a substantially elliptical Y-Z cross section, and pushes the rear end portion 201*c* of the movable contact part 201 of the first contact 20 upward when the actuator 40 is rotated so as to tilt downward as illustrated in FIG. 6. As a result of the rear end portion 201*c* being pushed upward by the cam part 403, the movable contact part 201 of the first contact 20 rotates about the connecting part 203 that elastically deforms, so that the contact projecting portion 201*b* of the front end portion 201*a* is pressed against a terminal on the upper surface of the connection object.

The connection object inserted into the connector 1 is fixed between the contact projecting portion 201*b* of the first contact 20 and the contact projecting portion 301*a* of the second contact 30 when the actuator 40 is rotated to the state illustrated in FIG. 6.

As described above, according to this embodiment, by providing the fixed contact part 202 of the first contact 20 with multiple fixing portions, it is possible to keep a fixing force of fixation of the first contact 20 to the housing 10, and it is possible to provide the connector 1 that has good transmission characteristics and is capable of performing high-speed transmission.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A connector to be mounted on a board and connect a connection object to the board, the connector comprising:

a housing that includes an insertion slot into which the connection object is inserted; and a plurality of contacts each of which comes into contact with the connection object and the board, each of the contacts including a movable contact that comes into contact with a first surface of the connection object;

a fixed contact that comes into contact with the board; and a connecting part that connects the movable contact and the fixed contact, so that the movable contact is rotatable relative to the fixed contact, wherein the fixed contact includes a first fixing portion that projects from the connecting part toward the insertion slot and fits into the housing; and a second fixing portion that projects toward the board and is latched by and fixed to the housing.

2. The connector as claimed in claim 1, wherein the second fixing portion is latched by and fixed to an end portion of the housing, and the end portion and the insertion slot are positioned at opposite ends of the housing.

3. The connector as claimed in claim 1, further comprising:

an additional contact that is fixed to the housing and comes into contact with a second surface of the connection object and the board.

4. The connector as claimed in claim 1, further comprising:

a pressing part configured to rotate the contacts and press the contacts against the connection object.

5. The connector as claimed in claim 1, wherein the contacts are provided so that a signal line and a ground line are adjacent to each other.

6. The connector as claimed in claim 1, wherein the fixed contact further includes a body portion extending from the connecting part in a direction away from the first fixing portion, and the second fixing portion projects from the body portion toward the board so as to hold the housing between the second fixing portion and the body portion.

* * * * *